United States Patent [19]

Nordstrom

[11] 4,171,673

[45] Oct. 23, 1979

[54] LINEAR COMPENSATING SYSTEM FOR AN AUTOMATIC SEWING MACHINE

[75] Inventor: Eric W. Nordstrom, Chicago, Ill.

[73] Assignee: Union Special Corporation, Chicago, Ill.

[21] Appl. No.: 931,808

[22] Filed: Aug. 7, 1978

[51] Int. Cl.[2] ..... D05B 21/00

[52] U.S. Cl. ..... 112/121.12

[58] Field of Search ..... 112/121.12, 121.11, 112/121.15, 207, 70, 65, 76; 74/112, 222

[56] References Cited

U.S. PATENT DOCUMENTS

| | | | |
|---|---|---|---|
| 3,965,830 | 6/1976 | Dorosz | 112/121.11 |
| 3,974,787 | 8/1976 | Kraatz et al. | 112/121.12 |
| 4,003,322 | 1/1977 | Yanikoski | 112/121.12 |
| 4,031,835 | 6/1977 | Gilbride et al. | 112/76 |
| 4,050,393 | 9/1977 | Welcher et al. | 112/121.12 |

*Primary Examiner*—H. Hampton Hunter

*Attorney, Agent, or Firm*—John W. Harbst; John A. Schaerli

[57] ABSTRACT

The disclosed invention describes an automatic sewing machine having a linear compensating system for moving a workholder relative to a fixed point. The driving power for the workholder is provided by a pair of stepping motors, each of whose mechanical output is operably connected by the linear compensating system to the workholder. A mechanical feed back means is associated with the system so that the workholder may be moved in a coordinate system which has been modified so that the movement of the workholder relative to the needle closely approximates a rectangular coordinate system.

18 Claims, 8 Drawing Figures

LINEAR COMPENSATING SYSTEM FOR AN AUTOMATIC SEWING MACHINE

BACKGROUND OF THE INVENTION

This invention relates, in general, to sewing machines and more particularly to an improved system for effecting the movement and location of a workholder utilized with an automatic sewing machine.

In an automatic sewing machine, an apparatus must be provided for moving a workpiece relative to the needle and, generally, it is the workpiece which is moved. The prior art sewing machines having a workholder moving in either a linear coordinate system or a polar coordinate system have certain drawbacks. When using a linear system it may be required to provide a guide for the workholder. The additional weight of such a guide increases the weight and thus inertia of the system, thereby reducing the rate of acceleration and deceleration of the system, and thus slowing the operation of the machine. As far as inertia is concerned, a non-linear or polar coordinate system reduces the inertia effects by the fact that a portion of the system is stationary. However, the main disadvantage of a non-linear system is the unwanted curvature which results. While this curvature can be compensated by altering the positioning commands to the motors, the step-wise correction inherent in the stepping motor system makes for an undesirable jagged line.

SUMMARY OF THE INVENTION

In view of the above, and in accordance with the present invention, there is provided a linear compensating system which is adapted for use with an automatic sewing machine utilizing a non-linear system for positioning an article relative a fixed point. With the present invention, a pair of mechanical drive means are functionally connected to the workholder by the compensating system such that, upon actuation of the motors, the workholder may be moved in two coordinate directions relative the fixed point. Associated with the system is a mechanical feed back means which symetrically effects the displacement of the workholder so that it may be moved relative the fixed point in what closely approximates a rectangular coordinate system. With the design and arrangement of the type herein described, it is possible to employ the advantages of a non-linear positioning system while at the same time substantially remove the curvature which normally results with such a system.

Therefore, a primary object of the present invention is to provide an improved means which overcomes the defects of the known prior art devices.

As will hereinafter appear, the invention comprises the devices, combinations and arrangements of parts hereinafter set forth and illustrated in the accompanying drawings of the preferred embodiment of the invention, from which the several features of the invention and the advantages attained thereby will be readily understood by those skilled in the art.

DESCRIPTION OF THE PREFERRED EMBODIMENT

Figure 1:
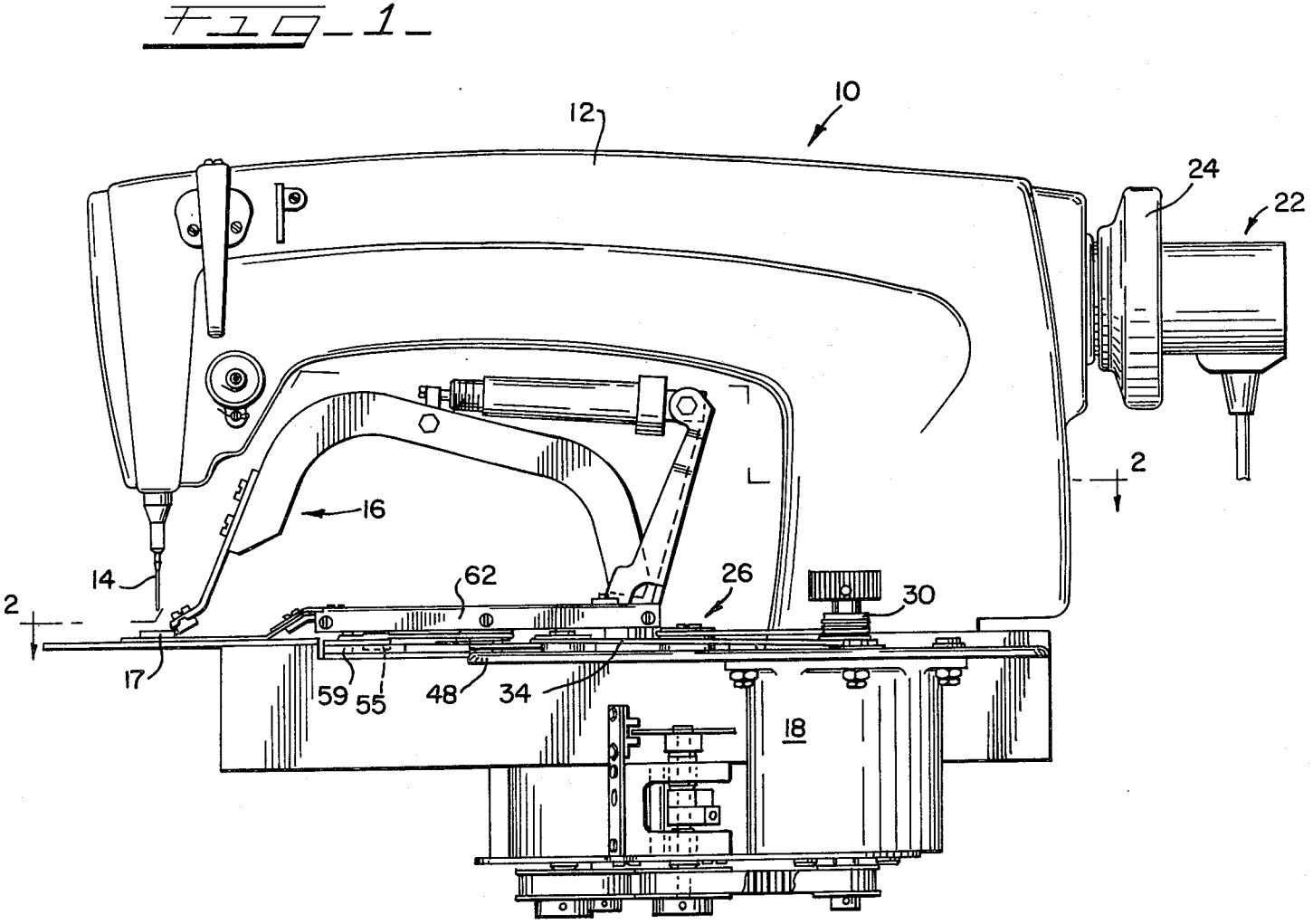
FIG. 1 is a side elevational view of a sewing machine incorporating the present invention.

With reference to the drawings and according to the present invention there is shown a programmed control sewing machine generally designated 10, having an overhanging arm 12, which accommodates a reciprocatory thread carrying needle 14. The workpiece to be sewn (not shown) may be held, generally, by a workholder assembly 16 having at one end a workpiece clamp 17 and at its other end is pivotally secured to the machine 10. The workholder or translator 16 is moved in a predetermined horizontal plane by a novel linear compensating power translation system. This system includes a pair of mechanical drive means or stepper motors 18 and 20 which are positioned on opposite sides of the arm 12 and which supply driving power to move the workholder in two coordinate directions termed X and Y coordinate or reference directions. The power translation system of the present invention acts to translate the rotary drive of the stepping motors to movement of the workholder in its two coordinate directions, with the Y coordinate direction being generally aligned with the longitudinal axis of arm 12, and with the X coordinate direction being transversed to the longitudinal axis of the arm.

The stepping motors 18 and 20 are driven by electrical signals from novel electrical circuitry which is set forth fully in a U.S. Pat. No. 4,051,794, to W. P. Herzer et al, the full teachings of which are incorporated herein by reference. These signals are synchronized to the movement of the needle 14 into and out of the workpiece by any suitable electro-mechanical synchronization unit generally designated 22. As is well known in the art, the unit 22 is connected to and driven by the handwheel 24 of the sewing machine and supplies synchronization signals to the electrical circuitry of the control system.

In this particular embodiment, the workholder is moved in a predetermined pattern relative to the movement and position of the needle. A sequence of instructions describing the desired pattern of stitching and movement of the workholder 16 is stored in a storage element or memory unit having a plurality of randomly addressable storage locations. For more detailed description of these aspects, reference should be made to the above identified patent.

Figures 2, 3, 5, 6:
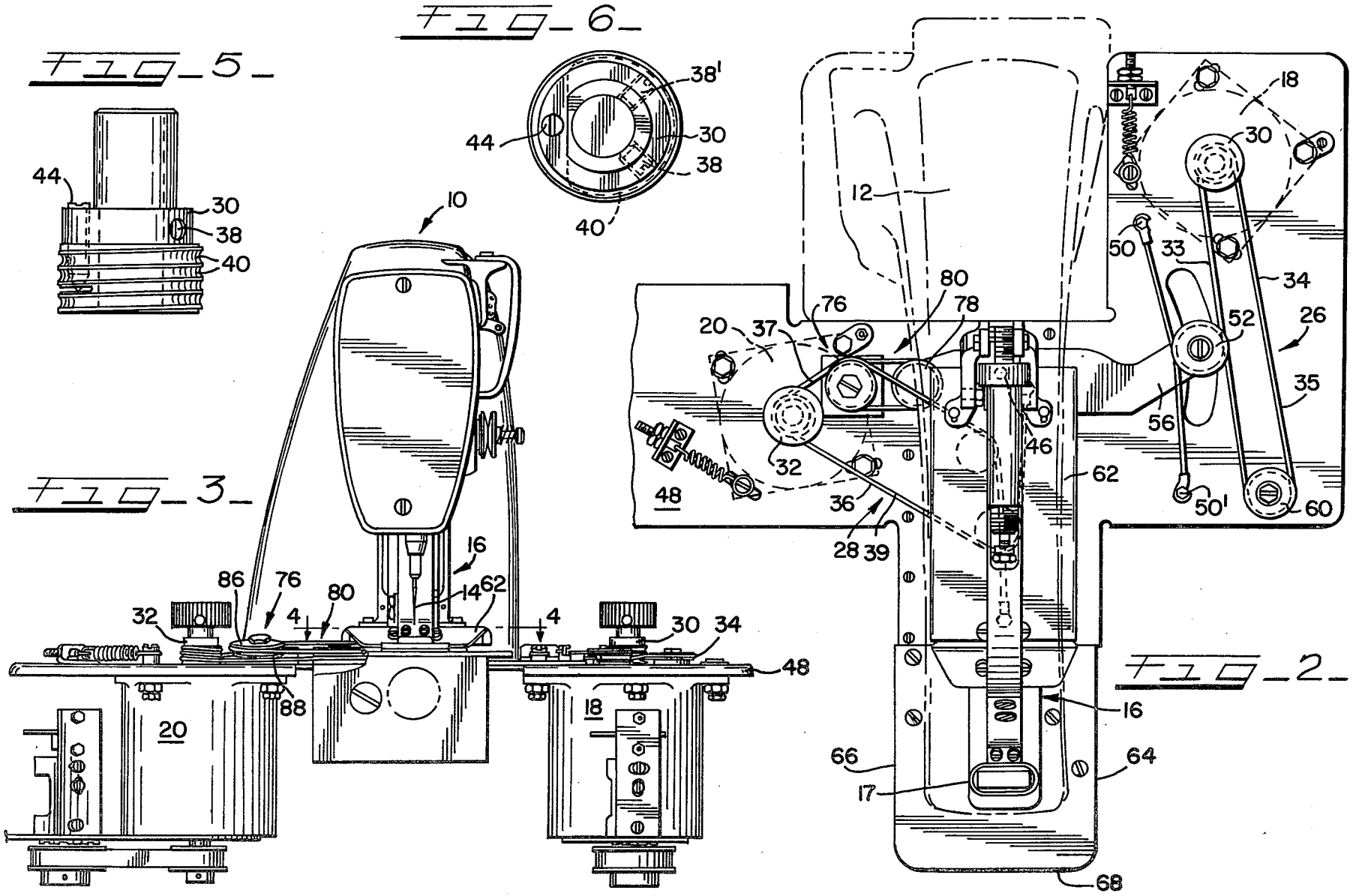
FIG. 2 is a top sectional view of the sewing machine of FIG. 1.
FIG. 3 is a front elevational view of the sewing machine of FIG. 1.
FIG. 5 is an elevational view of a pulley for driving the workholder means of the sewing machine of FIG. 1.
FIG. 6 is a top plan view of the pulley of FIG. 5.

As best shown in FIG. 2, the power translation system used to transmit power from the drive motors 18 and 20 to the translator 16 comprises two separate motion transfer assemblies 26 and 28, or other equivalent linkage assemblies, with one being provided for each coordinate direction. The motion transfer assemblies 26 and 28 are arranged as follows. In the preferred embodiment, the motion transfer assemblies 26 and 28 utilize cables 34 and 36 to transmit the necessary motion between the motors and the workholder. Cables 34 and 36 are wound about the periphery of pulleys 30 and 32, respectively, as will be discussed below. In this manner, the rotational movement of the stepping motors can be converted into linear movement of the cables.

Since the pulleys 30 and 32 and their associated structure may be substantially the same, the pulley 30 will be described as representative in connection with FIGS. 5 and 6. The pulley 30 may be secured to the associated output shaft of the stepper motor by any suitable means such as 38 and 38'. Each of the cables in the system have a first portion, a central or medial portion and a second portion. The medial portion of each associated cable may be wound a plurality of times, e.g., $2\frac{1}{4}$ to $2\frac{1}{2}$ rounds, in a spiral groove 40 formed about the periphery of the pulley, and is secured to the pulley in the manner shown by any suitable means such as screw 44. Thus, the appropriate cable is rigidly secured to each drive pulley. The first and second portions of the associated cable extend outwardly from the drive pulley and its ends are secured in a manner described hereinafter.

Figure 7:
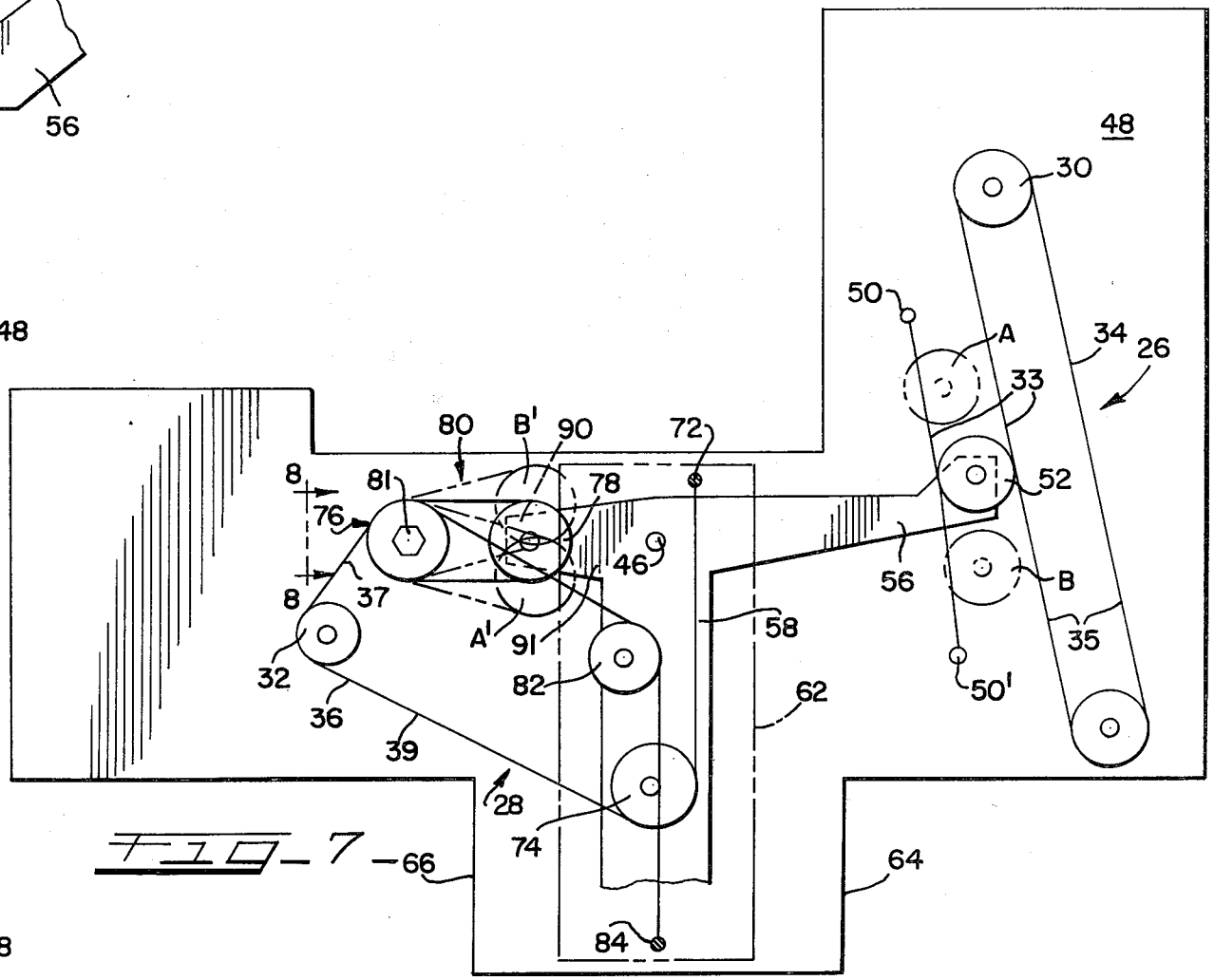
FIG. 7 is a diagrammatic view of the cable systems for the sewing machine of FIG. 1.

Referring to FIGS. 2 and 7, a pivot pin 46 which is secured to a base plate 48 of the sewing machine provides a pivot point for the workholder assembly 16 when same is moved by cable 34. Both ends of the cable 34 are secured to the plate 48 by any suitable means such as 50 and 50'. As best seen in FIG. 2, the first and second portions 33 and 35 respectively of cable 34 are threaded in opposite rotational directions about the upper and lower pulleys of a free turning pulley assembly 52. The pulley assembly 52 is rotatably mounted adjacent one end of a connecting member 56 extending from a pivoting arm 58 (FIG. 7) which is pivotally mounted on the base plate by the pivot pin 46. The first portion 33 of cable 34 passes from the pulley 52 to the motor pulley 30 while the second portion 35 of the cable passes from the pulley 52 to a free turning pulley 60 which is rotatably mounted on the plate 48. As shown, the second portion 35 of cable 34 is threaded around the pulley 60 from where it passes to the motor pulley 30. In this manner the cable 34 is threaded around the pulleys 30, 52 and 60 intermediate its ends.

Since the cable ends are fixed it will be apparent that as the stepping motor 18 rotates the motor pulley 30 the effective length of the second cable portion 35 will be shortened or enlarged depending upon the rotational direction of the motor 18, while the first cable portion 33 will be simultaneously enlarged or shortened in an inverse manner. Thus, it will be understood that during a sewing operation the pulley 52 does not remain stationary but instead oscillates between the phantom line positions A and B (FIG. 7) in order to effect the relative X motion of the workholder.

Since the pulley 52 is connected to member 56 movement of the pulley 52 is transferred into pivotal movement of the pivoting arm 58 about the pin 46. As is clearly described in the above identified patent, and as may be seen in FIG. 4, movement of the pivoting arm 58 is retained in a predetermined horizontal plane by retaining elements 55 and 57 which cooperate with a plate 59 secured to plate 48 so as to prevent the arm 58 from rising. The pivoting arm further carries an extendable arm 62 which is moveable longitudinally relative the pivotal arm 58 and has one end attached to the workholder 16. As will be described hereinafter, the extendable arm moves along the pivoting arm in a substantially radial direction relative the pivot point 46. Thus, as the arm 58 rotates about the pivot pin 46 so does the arm 62 and the workholder 16. Accordingly, clockwise rotation of the motor pulley 30 as viewed in FIG. 2, results in movement of the workholder 16 toward an edge 64 of the plate 48, which may be designated as movement in the −X direction, while the workholder is moved toward an opposing edge 66 of the plate 48 corresponding to counterclockwise rotation of the pulley 30, which will be termed +X direction.

It should be noted that during the operation of the machine the stepping motors 18 and 20 are permitted to pivot. However, there are suitable means provided which maintain continuous tension on the cables 34 and 36 through the motor pulley. The use of the above motor mounting structure for employment of the motor mass in dampening vibratory shocks to the cable system is set forth fully in the U.S. Pat. No. 3,974,787 to G. A. Kraatz et al.

Referring to FIGS. 2 and 7 and in accordance with the present invention, the end of the second portion 39 of cable 36 is secured to post 72 which depends from the extendible arm 62 adjacent one end thereof remote from the workholder 16. From the post 72, the cable is threaded around a free turning pulley 72 which is rotatably mounted to the base plate 48 by any suitable means. The second portion of cable 36 passes from pulley 74 to the motor pulley 32. As mentioned above, the medial portion of the cable may be secured to the pulley 32 in a manner similar to the way cable 34 was secured to pulley 30. Extending from the motor pulley is the first portion 37 of cable 36. The first portion of cable 36 passes around both a free turning pulley assembly 76 and a pulley 78 which, as will be described hereinafter, is carried by arm 58. As shown, the first portion of cable 36 is passed about the pulley 78 and is returned, once again, to the pulley assembly 76 such that a portion of cable 36 is threaded around both the pulley assembly 76 and pulley 78 intermediate the points at which it is connected to the motor and its end whereby forming a mechanical feed back means which in this embodiment may be in the form of an expansionary/contractionary loop 80. Upon leaving the expansionary and contractionary loop, the first portion of the cable is threaded to yet another free turning pulley 82 which is mounted on the base plate 48 beneath the arm 62 by any suitable means. The end of the first cable portion 37 passing from pulley 82 is secured to post 84 depending from the other end of arm 62 adjacent the workholder 16.

It will be apparent, that as the motor 20 rotates, that portion 37 of cable 36 intermediate the connection point on the drive pulley 32 and the post 84 will be shortened or enlarged depending on the rotational direction of the motor, while the second portion 39 of the cable intermediate the connection point on the drive pulley 32 and post 72 will be simultaneously enlarged or shortened in an inverse manner. It is important to note, however, that it is the effective or active length of the first cable portion which locates the position of the workholder relative the needle in response to movement of the motor 20. Thus, as viewed in FIG. 2 rotational movement of the motor pulley 32 is translated into radial or longitudinal movement of the extendable arm 62 and workholder relative the needle 14. More particularly, movement of the drive pulley 32 in a clockwise direction results in movement of the workholder toward an outer edge 68 (FIG. 2) of the plate which may be designated as movement in the +Y direction, while counterclockwise rotation of the motor pulley 32 results in radial movement of the arm 62 and workholder 16 in a direction away from the edge 68 termed the −Y direction. Accordingly, it will be seen that simultaneous energization of the X and Y stepper motors 18 and 20 respectively, causes simultaneous pivotal and radial movement of the workholder 16 in the X and Y coordinate directions.

Though, at first glance, the coordinate system in which the workholder moves appears to be polar or non-linear, that is, a coordinate system having a radial component delivered by moving the extendible arm 62 over the pivoting arm 58 and an angular component delivered by rotating the pivoting arm 58 about pivot pin 46, the mechanical feed back means associated with the transfer system 28 allows the workholder to move in what closely approximates a rectangular coordinate system with respect to the needle 14. The circular line of stitching which would normally results from use of a non-linear coordinate system is modified such that a straight line of stitching as would be created in a rectangular coordinate system may be traced by the clamp 17 when it is pivoted about pivot pin 46.

As is appreciated, simulation of a rectangular coordinate system through the utilization of a non-linear system has beneficial results but yet is a difficult accomplishment to achieve, especially in the extreme corners of the work area. Although a close approximation of a straight line of stitching was set forth in the aforementioned U.S. Pat. No. 4,051,794, it is a feature of the present invention to introduce means which even more closely approximate a rectangular coordinate system and substantially removes the curvature resulting from the rotational movement of arm 58.

Figure 4:
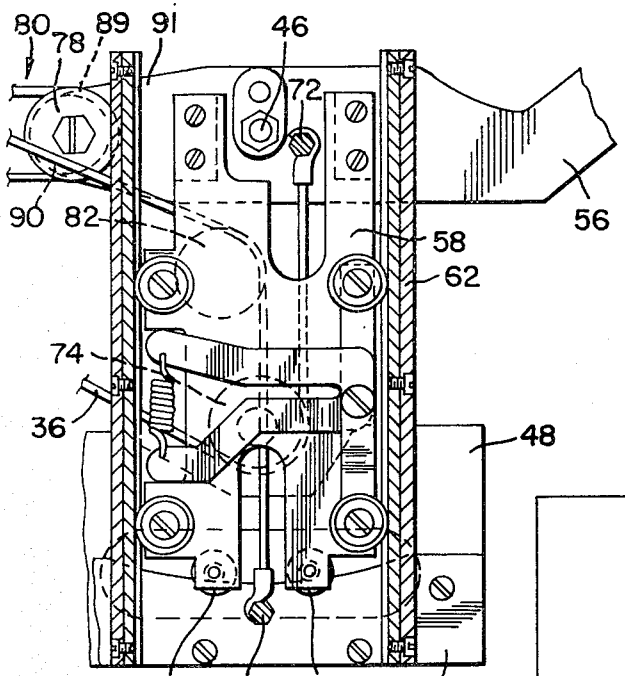
FIG. 4 is a top sectional view of the pivotal and extendable arm means of the sewing machine of FIG. 1.
Figure 8:
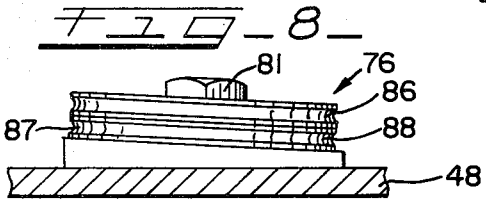
FIG. 8 is an elevational view of a pulley assembly for the sewing machine of FIG. 1.

As was set forth above, with the present invention, the first portion 37 of cable 36 extends from the motor pulley 32 and is threaded to the pulley assembly 76. The pulley assembly 76 includes upper and lower pulleys 86, 88 respectively, which are carried in a stacked or aligned relationship on a post 81 secured to the plate 48. As best seen in FIG. 8, the pulleys 86 and 88 are mounted for rotation in a plane offset from the plane traversed by the translator means for reasons which will be described in greater detail hereinafter. The first portion of the cable passes from the lower pulley 88 to the pulley 78 which is illustrated in FIGS. 4 and 7 as rotatably mounted adjacent end 90 of the connecting member 91 extending from the arm 58. The pulley 78 is disposed in a position intermediate pulley assembly 76 and pivot point 46. One half turn of the cable passes around the pulley 78 and returns to the upper pulley 86 of the double pulley assembly 76. The cable passes around the upper pulley 86 and is threaded to pulley 82 and post 84 in the manner described above.

It will be apparent that the reason for mounting the pulley assembly 76 for rotation in an inclined plane is that the inclination allows the cable 36 to approach and wrap around the pulley 88 at a first level while allowing the cable segment returning from pulley 78 to approach the pulley 86 at a second level thus allowing the formation of the expansible/contractible loop 80. This method of mounting the pulleys 86 and 88 also decreases the slope of the cable between pulleys 88 and 78 whereby lessening the chance of the cable slipping out from grooves 87 and 89 of pulleys 88 and 78 respectively.

The radial or Y position of the extendible arm 62 and thus workholder 16 for a particular angular position of arm 58 is determined from a number of considerations. First, the position of workholder 16 is determined by the relative positions of pivot point 46, pulley 82, pulley 74 and the needle centerline. Taken alone, these relationships can approximate a straight line of stitching. However, the addition of an expansionary/contractionary loop 80 formed by encircling both pulleys 76 and 78 with the first portion 37 of cable 36 enhances the linearity of the system.

As with pulley 52 during the sewing operation, the pulley 78 does not remain stationary but instead oscillates about an arcuate path between phantom line positions A′ and B′ and affects the Y position of the workholder relative the needle as will be discussed.

As mentioned above, it is the effective or active length of the first cable portion 37 which locates the workholder relative the needle. From FIGS. 2 and 7, it is apparent that the expansionary/contractionary loop 80 is included in the first cable portion. Therefore, as arm 58 pivots, the pulley 78 is carried therewith and the result is to alter the path traveled by cable 36. As the arm 58 pivots from its center position, shown in FIG. 7, the amount of cable course comprising loop 80 will vary as a function of the degree of pivotal movement of arm 58 and, thus, the effective or active length of the first cable portion will also be changed. That is, when moving from its solid line position, shown in FIG. 7, to either phantom line position A′ or B′ the pulley 78 is moved in a direction generally perpendicular to the movement of the translator and away from the pulley assembly 76 thus pulling on cable 36 so as to distend the loop 80 and thus shortening the effective length of the first portion of the cable. It is this change in the effective length of the first portion of the cable which substantially removes the curvature that may normally result from the rotational movement of arm 58. That is, the compensatory effect imparted to the system by the mechanical feed back means corrects for the curvature inherent with non-linear systems by effecting the location of the clamp 17 relative the needle in the Y coordinate direction and thus enables the needle to sew along a path which approximates a straight line when only rotational movement is imparted to the workholder by the cable system 34.

In the particular embodiment shown in the drawings, the best compensatory effects are realized by: (1) making the distance between the pivot pin 46 and the centerline of pulley 82, 1.500 inches, (2) making the distance between pivot pin 46 and the centerline of pulley 74, 3.375 inches, (3) making the distance between the centerline of pivot pin 46 and the needle centerline 9.000 inches, (4) making the distance between the pivot point 46 and the centerline of pulley 78, 2.016 inches, and (5) making the distance between pivot point 46 and the centerline of pulley assembly 76, 3.375 inches. These dimensions can be scaled up or down in larger or smaller, equipment as long as the relationship between them remains the same.

As seen in FIG. 7, in order to maintain the compensation symmetrical in the Y coordinate direction, when arm 58 is in its center position, pulley 78 lies on the line extending between pulley assembly 76 and pivot point 46. In this manner, as pivoting arm 58 moves about pin 46, from its center position, the amount of cable in the loop increases as a function of the angle through which arm 58 is moved. As a result of the location of pulley 78 relative pulley 76 the compensatory effect will remain the same regardless of the direction of pivotal movement of arm 58 from the center position.

In accordance with the present invention, the expansionary/contractionary loop 80 allows movement of the workholder in a coordinate system which has been modified so that the movement of the workpiece relative the needle closely approximates a rectangular coordinate system. The expansionary/contractionary loop automatically compensates for the rotation of the pivotal arm by adjusting that portion of the system which locates the workholder. Thus, imperfections inherent with polar coordinate systems are substantially eliminated.

Thus, it is apparent that there has been provided in accordance with the present invention, an apparatus for positioning the workholder of an automatic sewing machine that fully satifies the objects, aims, and advantages set forth above. While the invention has been described in conjunction with the specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed:

1. An automatic sewing machine having a needle, an element moveable relative said needle, said element having first and second end portions, and a non linear system for moving said element comprising:

first and second mechanical drive means;

a first motion transfer means operatively connecting said element and one of said drive means, said element being positionable about a pivot point in a first coordinate direction, with said moveable element having an angular position about said pivot point controlled by said first motion transfer means;

a second motion transfer means operatively connecting said element and said second drive measn for controlling the movement of said element in a second coordinate direction; and means responsive to changes in the angular orientation of said moveable element and associated with said second motion transfer means for effecting the position of said moveable element in the second coordinate direction so that approximately a straight line is traced out by the first end portion of said element whenever the moveable element is pivoted about said pivot point.

2. The automatic sewing machine of claim 1 wherein said second motion transfer means comprises a cable having first and second ends.

3. The automatic sewing machine of claim 2 further including a first pulley means having an axis which is fixed relative said pivot point and wherein said means responsive includes a second pulley means disposed intermediate said first pulley means and said pivot point, and an expansible/contractible loop formed by wrapping said cable means about said first and second pulley intermediate its ends.

4. The automatic sewing machine of claim 3 wherein the distance between said first and second pulley means varies as the moveable element is moved in the first coordinate direction relative said needle whereby changing the size of said expansible/contractible loop.

5. The automatic sewing machine of claim 3 wherein the axis of said second pulley means lies along a line extending between said pivot point and the axis of said first pulley means in at least one portion of said moveable element.

6. The automatic sewing machine of claim 3 wherein the cable comprises a first portion means the effective length of which determines the position of said moveable element relative said needle, said first portion means connecting the mechanical drive means and the moveable element at a first location, and a second portion means for connecting the mechanical drive means to the moveable element at a second location.

7. The automatic sewing machine of claim 6 wherein said expansible/contractible loop is adapted to alter the effective length of the first portion of said second cable means whereby effecting the location of said moveable element relative said needle.

8. The automatic sewing machine of claim 6 wherein said first and second locations are spaced from each other.

9. A motion transfer assembly which provides the couplings necessary for moving a workholder of an automatic machine relative a fixed point, said motion transfer assembly comprising:

means for mounting said workholder for pivotal and longitudinal movement relative said fixed point;

first and second mechanical drive means;

a first linkage means operatively connected to the workholder and said first mechanical drive means such that said workholder is pivotally moved upon actuation of said first drive means;

a second linkage means operatively connecting the workholder and said second mechanical drive means such that said workholder is moved longitudinally relative said fixed point upon actuation of said second drive means; and means operative responsively to pivotal movement of said workholder and effective to adjust the longitudinal position of said workholder as a function of the degree of pivotal movement of said workholder relative said fixed point.

10. An automatic sewing machine having a needle for operating on an article, a frame for receiving and holding said article, translator means moveable in a predetermined plane and having said frame mounted thereon, control means for causing operation of said needle on said article, and an improved low inertia means for moving said translator and said frame relative said needle comprising:

mounting means supporting said translator means for displacement in two coordinate directions;

first and second stepper motors adapted to position said translator and frame in response to signals from said control means;

a first cable means functionally connected to said first stepper motor and operative to move said translator in a first coordinate direction upon actuation of one of said motors;

a second cable means connected to the other motor and adapted to move said translator in a second coordinate direction upon actuation of said other motor; and means responsive to the orientation of said translator in the second coordinate direction and effective to concomitantly aid said first motor in positioning said translator relative said needle in the first coordinate direction.

11. The invention of claim 10 further including a first pulley assembly having an axis which is fixed relative said pivot point and wherein said means responsive includes a second moveable pulley disposed intermediate said first pulley assembly and said pivot point and a distendable loop means formed by threading said second cable means about said first and second pulleys intermediate its ends.

12. The invention of claim 11 wherein said first pulley assembly includes a plurality of aligned pulleys, said pulleys being rotatably disposed in an offset relationship with respect to the plane in which said translator means is moved.

13. The invention of claim 11 wherein said second pulley is adapted to be operatively secured to said mounting means and angularly responsive to the directions of movement thereof.

14. The invention according to claim 11 wherein said second pulley is supported for movement in a direction which is generally perpendicular to the displacement of said translator in the second coordinate direction.

15. An automatic sewing machine comprising:

a sewing needle;

pivotal and extendible arm means having a workholder adjacent one end of the arm means for holding an article during sewing, said arm means and workholder being moveable relative the needle;

first and second stepper motor means;

a first elongated flexible element adapted to functionally connect said first motor means and said pivotal arm means and effective to position said arm in a first coordinate direction upon actuation of said motor;

a second elongated flexible element adapted to functionally connect said second motor means and said extendible arm means and effective to position said arm in a second coordinate direction; and means rendered effective upon movement of said pivotal arm means to concomitantly aid in positioning said extendible arm means relative said sewing needle.

16. In an apparatus according to claim 15 wherein said concomitantly aiding means includes a member carried as part of said pivotal arm means, said member being arranged to manipulate a portion of said second flexible element such that a generally straight line is traced on the article whenever the extendable arm is moved in the second coordinate direction.

17. An automatic sewing machine having a needle, a workpiece clamp adapted to receive and hold an article, said clamp being slideably and pivotally mounted for movement along first and second axes relative said needle, said movement being derived from motors which are operatively connected to the clamp through a non-linear linkage system comprising:

first linkage means operative to pivotally move said workpiece clamp upon actuation of one of said motors;

a second linkage means operative to slideably move said workpiece clamp upon actuation of the other motor; and mechanical feed back means operative responsively to the pivotal movement of said workpiece clamp and effective to modify the slideable movement of said clamp so as to compensate for the non-linearity of the linkage system.

18. An automatic sewing machine having a needle, a pivotal and slideable workholder assembly, said workholder assembly having a clamp for receiving and holding a workpiece, and a translating system for moving said clamp relative said needle comprising:

first and second mechanical drive means adapted to position said workholder assembly;

first means operative to move and angularly position said workholder assembly in a first coordinate direction upon actuation of said first mechanical drive means;

second means operative to slideably move said workholder in a second coordinate direction upon actuation of said second motor means; and means responsive to changes in the orientation of said first means operative and effective to aid in positioning said workholder assembly in the second coordinate direction such that a generally straight line is traced out by the clamp whenever the workholder assembly is pivotally moved.

* * * * *